US008458860B2

(12) United States Patent
Fregoni et al.

(10) Patent No.: US 8,458,860 B2
(45) Date of Patent: Jun. 11, 2013

(54) CLOSURE AND TIGHTENING DEVICE FOR A SPORTS BOOT

(75) Inventors: Andrea Fregoni, Paese (TV) (IT); Giovanni Girolimetto, Paese (TV) (IT)

(73) Assignee: Rossignol Lange S.r.l., Mollaro (IT)

( * ) Notice: Subject to any disclaimer, the term of this patent is extended or adjusted under 35 U.S.C. 154(b) by 822 days.

(21) Appl. No.: 12/044,421

(22) Filed: Mar. 7, 2008

(65) Prior Publication Data

US 2008/0222923 A1 Sep. 18, 2008

(30) Foreign Application Priority Data

Mar. 13, 2007 (EP) ..... 07425144

(51) Int. Cl.
*A43C 11/00* (2006.01)
*A43C 11/14* (2006.01)
*A43B 5/04* (2006.01)

(52) U.S. Cl.
USPC ..... 24/68 SK; 24/69 SK; 24/70 SK; 24/71 SK; 36/50.5

(58) Field of Classification Search
USPC ..... 24/68 SK, 69 SK, 70 SK, 71 SK, 24/311; 36/50.5
See application file for complete search history.

(56) References Cited

U.S. PATENT DOCUMENTS

| | | | | | |
|---|---|---|---|---|---|
| 3,173,182 | A | * | 3/1965 | Tuefel | 24/68 SK |
| 3,182,366 | A | * | 5/1965 | Tuefel | 24/68 SK |
| 3,363,288 | A | * | 1/1968 | Lange et al. | 24/68 SK |
| 3,491,465 | A | | 1/1970 | Martin | |
| 4,051,611 | A | * | 10/1977 | Chalmers | 36/50.5 |
| 4,112,557 | A | * | 9/1978 | Salomon | 24/69 SK |
| 4,470,175 | A | * | 9/1984 | Chiarella | 24/70 SK |
| 4,541,147 | A | * | 9/1985 | Olivieri | 24/68 SK |
| 4,546,521 | A | * | 10/1985 | Ribarits | 24/70 SK |
| 4,651,392 | A | * | 3/1987 | Olivieri | 24/71 SK |
| 4,893,384 | A | * | 1/1990 | Bidoia et al. | 24/68 SK |
| 5,136,794 | A | * | 8/1992 | Stampacchia et al. | 36/118.7 |
| 5,383,258 | A | * | 1/1995 | Nicoletti | 24/68 SK |
| D363,690 | S | * | 10/1995 | Gallon et al. | D11/216 |
| 5,509,180 | A | * | 4/1996 | Benetti et al. | 24/68 SK |
| 5,553,400 | A | * | 9/1996 | Wittmann et al. | 36/50.5 |
| 5,669,122 | A | * | 9/1997 | Benoit | 24/71 SK |
| 5,715,582 | A | * | 2/1998 | Zorzi | 24/71 SK |
| 5,974,633 | A | * | 11/1999 | Sartor et al. | 24/71 SK |
| 6,282,758 | B1 | * | 9/2001 | Lin | 24/71 SK |

FOREIGN PATENT DOCUMENTS

| | | |
|---|---|---|
| AT | 336 447 | 12/1973 |
| DE | 39 20 151 A1 | 12/1989 |
| FR | 1 373 424 | 10/1963 |
| FR | 2 755 834 A1 | 5/1998 |

* cited by examiner

*Primary Examiner* — Robert J Sandy
*Assistant Examiner* — Tyler Johnson
(74) *Attorney, Agent, or Firm* — Frommer Lawrence & Haug, LLP; Ronald R. Santucci

(57) ABSTRACT

Connecting member for a sports boot closure and tightening device (4), comprising a base (25, 35) adapted to be fixed on the surface of the sports boot and a connecting element (31, 37) adapted for cooperation with a second connecting member, wherein the connecting element (31, 37) has a geometry such that its tangent (c, d; c') to the zone where it connects with a second connecting element of the second connecting member is not perpendicular to the closure direction of the connecting member in the configuration in which it closes and tightens the sports boot.

5 Claims, 2 Drawing Sheets

CLOSURE AND TIGHTENING DEVICE FOR A SPORTS BOOT

This application claims priority benefits from European Patent Application No. 07425144.8 filed Mar. 13, 2007, the disclosure of which is hereby incorporated by reference.

BACKGROUND OF THE INVENTION

The invention relates to a device for closing and tightening a sports boot, this device comprising two connecting members adapted to cooperate with one another, which device is particularly adapted for rigid boots such as a ski boot. It also relates to each of these connecting members per se. Lastly, it relates to a sport boot equipped with such a closure and tightening device.

DESCRIPTION OF THE PRIOR ART

FIG. 1 illustrates a conventional ski boot 1 of the prior art, composed of a cuff 2 articulated on a shell 3. These two rigid parts 2, 3 are open at the level of the front part of the boot, forming a notch which makes it easier to put the boot on and take it off despite the rigidity of the boot. The latter is furthermore provided with four closure and tightening devices 4, two on the cuff 2 and two on the shell 3, of the type illustrated in FIG. 2. Each closure and tightening device 4 is composed of two complementary connecting members. The first member comprises a base 5 adapted to be fixed on the boot and carrying a tightening lever 6, which is mounted so that it can move in rotation on the base 5 about an axle 7, is adapted to drive a tie-rod 8 mounted on the lever 6 about another axle 9 and is connected to an end part 10 of the connecting member, the extremity of which comprises a transverse connecting bar 11. The second member comprises a base 15 for fastening it on a boot and a ratchet 16 comprising various teeth 17, which are adapted to cooperate with the transverse connecting bar 11 and represent different degrees of tightness. Each connecting member of this connecting device 4 is fixed on the boot on either side of the notch, the base 5 of the first member being fixed on a rigid lateral part 19 of the boot, opposite the base 15 of the second connecting member fixed on a more flexible tongue 20 adapted to cover the notch of the boot. These two connecting members can sometimes be moved in rotation about the point where they are fastened to the surface of the boot. When the boot is in a closed position, however, the two complementary connecting members are placed on the same curve 18 at the surface of the boot, which represents the shortest possible path of these connecting members between the two bases 5, 15. We will somewhat inaccurately use the term "alignment on the curve 18" to describe this closure position of the two connecting members. This alignment curve 18 of the connecting members is substantially perpendicular to the notch to be closed. In this closed configuration, the two connecting members are joined, the connecting bar 11 being in engagement with a tooth 17 selected as a function of the desired tightness, the tightening being carried out by actuating the lever 6. The connecting bar 11 and the teeth 17 have respective orientations a, b perpendicular to the curve 18, so that the force exerted by the connecting bar 11 on a tooth 17 causes the tongue 20 to be moved in a direction substantially perpendicular to the notch, in order to close the boot then tighten it, still in the same direction parallel to the curve 18. In the illustration in FIG. 1, the curves 18 shown furthermore represent a symmetry axis of the closure and tightening devices. This is not however compulsory; the devices may be asymmetric.

Document FR2755834 describes an alternative embodiment of a closure and tightening device as described above, in which the connecting members have an adjustable position on the surface of the boot, so as to make it possible to modify the positioning of the alignment curve 18 of the connecting members as a function of the shape of the foot in order to improve the comfort of the boot. This solution presents numerous drawbacks, including:

- it has a high degree of complexity owing to the mechanism for adjusting the positioning of the elements on the surface of the boot;
- it increases the size of the accessories on the surface of the boot, which on the one hand restricts their use to the level of the instep because this is the only zone with an area large enough to accommodate them, and on the other hand it stiffens the boot owing to the increased surface area of metal;
- it also increases the thermal bridges to the outside owing to the presence of the metal, which reduces its comfort;
- lastly, the latitude for adjustment using this solution remains very restricted and the advantage offered is not satisfactory in view of the drawbacks mentioned.

All the solutions of the prior art are based on closing and tightening the sports boot by bringing together two parts 19, 20 of the boot using connecting members which are positioned on each of the parts and are aligned, by means of a retraction force exerted on these two parts in the orientation in which these connecting members are aligned, which is generally close to a direction substantially perpendicular to the notch of the boot. Such a solution is highly suitable for closing the notch of the boot, but is not optimal for ensuring best holding of the foot.

SUMMARY OF THE INVENTION

It is therefore an object of the present invention to provide another closure and tightening device for a sports boot, which improves the tightening and holding of the foot in the boot while ensuring that the boot is closed.

According to the concept of the invention, the closure and tightening of the boot are carried out by connecting members which exert an additional force component, outside the alignment of at least one of the connecting members, this non-aligned component reinforcing a function of holding the foot in the boot.

The invention is defined more precisely by the claims.

DESCRIPTION OF THE DRAWINGS

These objects, features and advantages of the present invention will be explained in detail in the following description of a particular embodiment, given without implying limitation with reference to the appended figures in which.

DESCRIPTION OF THE PREFERRED EMBODIMENTS

Figure 3:
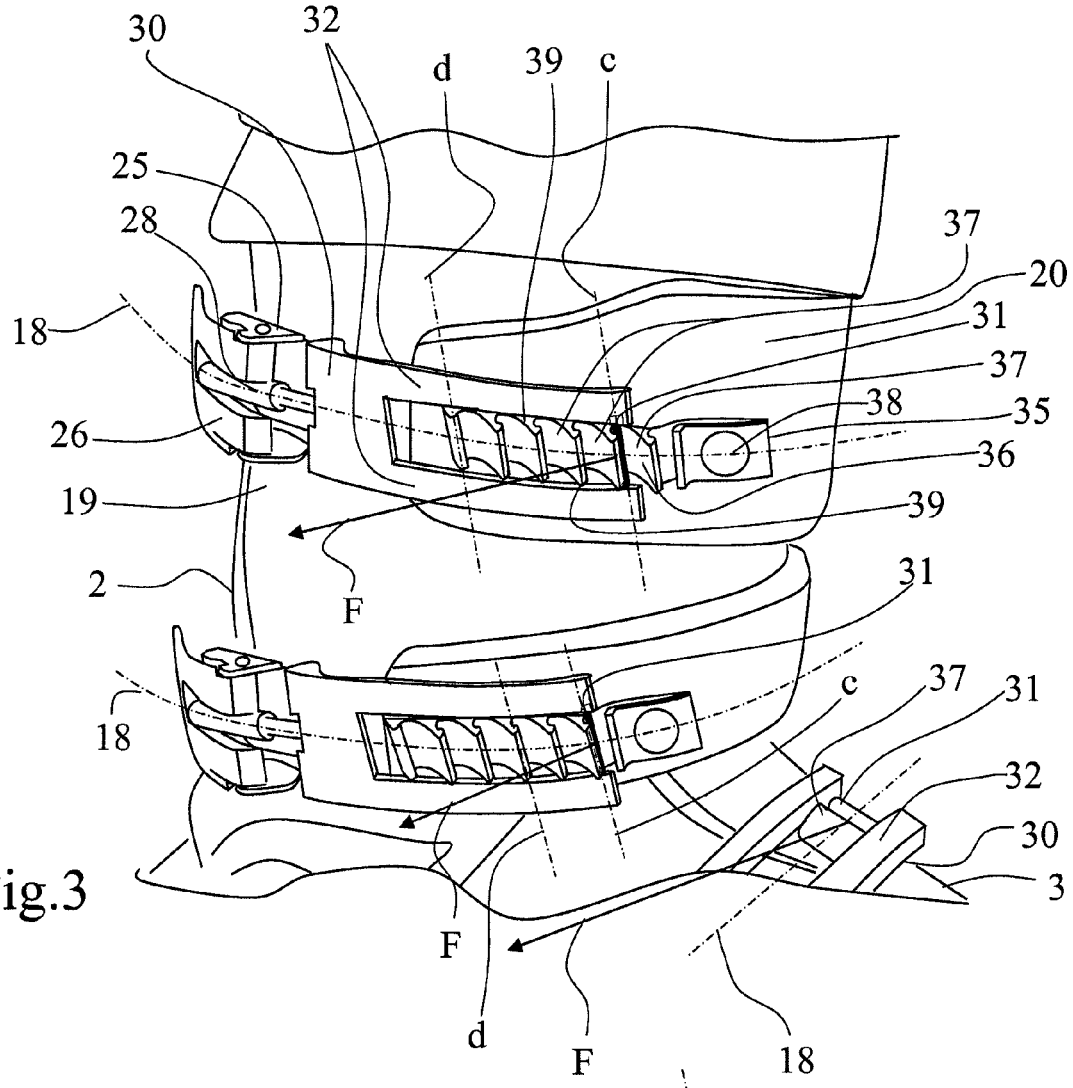
FIG. 3 represents a closure and tightening device according to one embodiment of the invention, in a partial view of the side of a ski boot cuff.

FIG. 3 illustrates a partial view of a ski boot comprising closure and tightening devices according to one embodiment of the invention. Each device is based on two connecting members mounted respectively on a first lateral part 19 of the boot and on a second lateral part of the boot, consisting for example of a flexible tongue 20, arranged beyond its front notch. The first connecting member comprises a base 25, carrying a tightening lever 26 which is mounted so that it can move in rotation on the base 25 and is adapted to drive a tie-rod 28, which is mounted on the lever 26 and connected to an end part 30 of the connecting member, the end of which comprises a connecting bar 31. The second connecting member comprises a base 35 fixed on the surface of a tongue 20 by a fastening means 38 of the rivet type, and a ratchet 36 comprising various teeth 37 which are adapted to cooperate with the transverse connecting bar 31 and represent different degrees of tightness. The connecting members are advantageously fixed on the boot by a fastening means 38 which prevents them from rotating with respect to the boot, so as to maximize the orientation movement of the tongue 20 due to the forces exerted by the connecting members. This fastening may consist of at least two rivets, or one rivet associated with a complementary system for blocking the rotation. The boot comprises two closure and tightening devices at the level of its cuff 2, and at least one at the level of its shell 3 (partially illustrated). As a variant, at least one of the connecting members could be movable in rotation about the fastening point 38 so that it can be positioned more easily in alignment with the first connecting member in order to close the boot.

In a closed configuration of the boot, each connecting member is aligned along a predefined closure direction. When the two connecting members cooperate in the configuration in which they close the boot, in this embodiment their respective closure directions are aligned. Specifically, they are positioned with an alignment represented by the curve 18 on the surface of the boot, which represents the shortest distance for joining the two connecting members from their respective bases 25, 35. It will be noted that the tie-rod 28, its point of connection with the end part 30 and the centre of connection of the ratchet 36 with its base 35 are then in particular aligned on the curve 18. The two parallel branches 32 of the fork-shaped end part 30 and the two parallel side faces 39 of the ratchet 36 are positioned on a curve parallel to the alignment curve 18.

According to the present invention, the connecting bar 31 of the first connecting member is oriented in a direction c not perpendicular to the two parallel branches 32 of the fork-shaped end part 30. Furthermore, the teeth 37 of the ratchet 36 likewise have an orientation d not perpendicular to the two parallel side faces 39 of the ratchet. These two directions c and d are the same in the closed configuration of the boot, so that the straight connecting bar 31 cooperates perfectly with the teeth 37 of the ratchet. By virtue of this geometry of the connecting elements 31, 37 of the connecting members, the connecting bar 31 exerts a force F perpendicular to the directions c, d, and therefore not parallel to the tangent to the curve 38, on the selected tooth 37.

The orientation of the connecting elements 31, 37 is preferably selected so that this force F has a component downward at the level of the cuff and rearward at the level of the shell. This force is naturally transmitted to the structure of the boot then to the user's foot. This force component, not aligned with the rest of the connecting members, thus makes it possible to add an additional effect of holding the foot in the boot. At the level of the cuff, the boot exerts a force which pushes the lower leg toward the ground, thereby improving the hold of the heel at the bottom of the boot while preventing it from moving upward. At the level of the shell, the boot exerts a force which pushes the foot toward the rear, thereby also improving the hold of the heel at the bottom of the boot while preventing it from moving forward.

Naturally, the angle of the teeth 37 and the connecting bar 31 is selected as a function of the desired distribution of the tightening force between its traditional component for closing the notch and its new component for improving the hold of the foot. Thus, different geometries could be selected without departing from the scope of the invention. It will be noted that an angle from 5 to 10 degrees between the directions c and d of these elements and the alignment direction 18 of the connecting members represents an advantageous solution.

Figure 4:
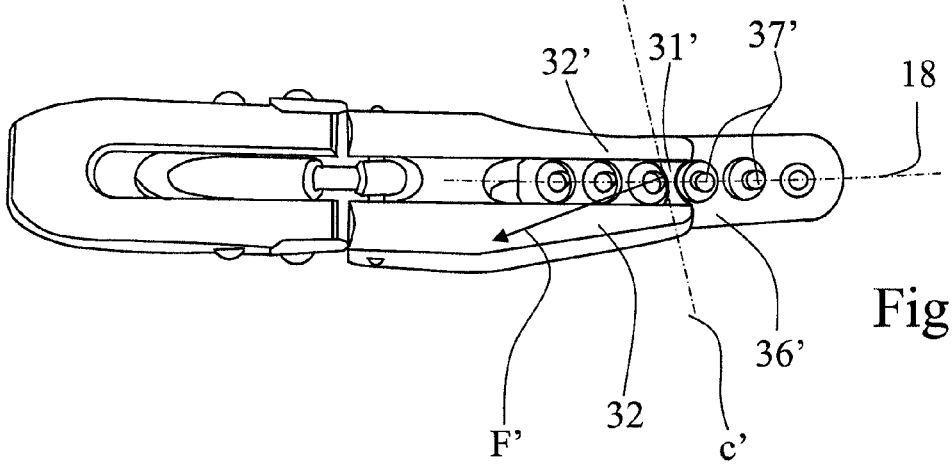
FIG. 4 illustrates an alternative embodiment of the closure and tightening device according to the invention.

The concept of the invention may of course be implemented with other geometries of the connecting members, and in particular the connecting elements 31, 37. FIG. 4 represents a possible variant of the connecting members, which differs essentially by the shape of the connecting elements 31', 37'. Thus, the first connecting member comprises a connecting element in the form of a curved tie-rod 31' arranged between two more complexly shaped branches 32' which are not entirely parallel. The second connecting member has a ratchet, the connecting elements of which are mushroom-shaped studs 37'. The cooperation between the connecting elements 31' and 37' takes place along a curve whose tangent c' is not perpendicular to the alignment curve 18. These elements thus exert a force F, perpendicular to this tangent c', which is not aligned with the alignment curve 18 of the connecting members, in order to obtain the same technical effect as in the embodiment represented above.

Lastly, in extension of the variant illustrated in FIG. 4, any other alternative embodiment (not shown) is possible in which a single one of the connecting elements has an inclination while the second connecting element has a conventional geometry.

Figure 1:
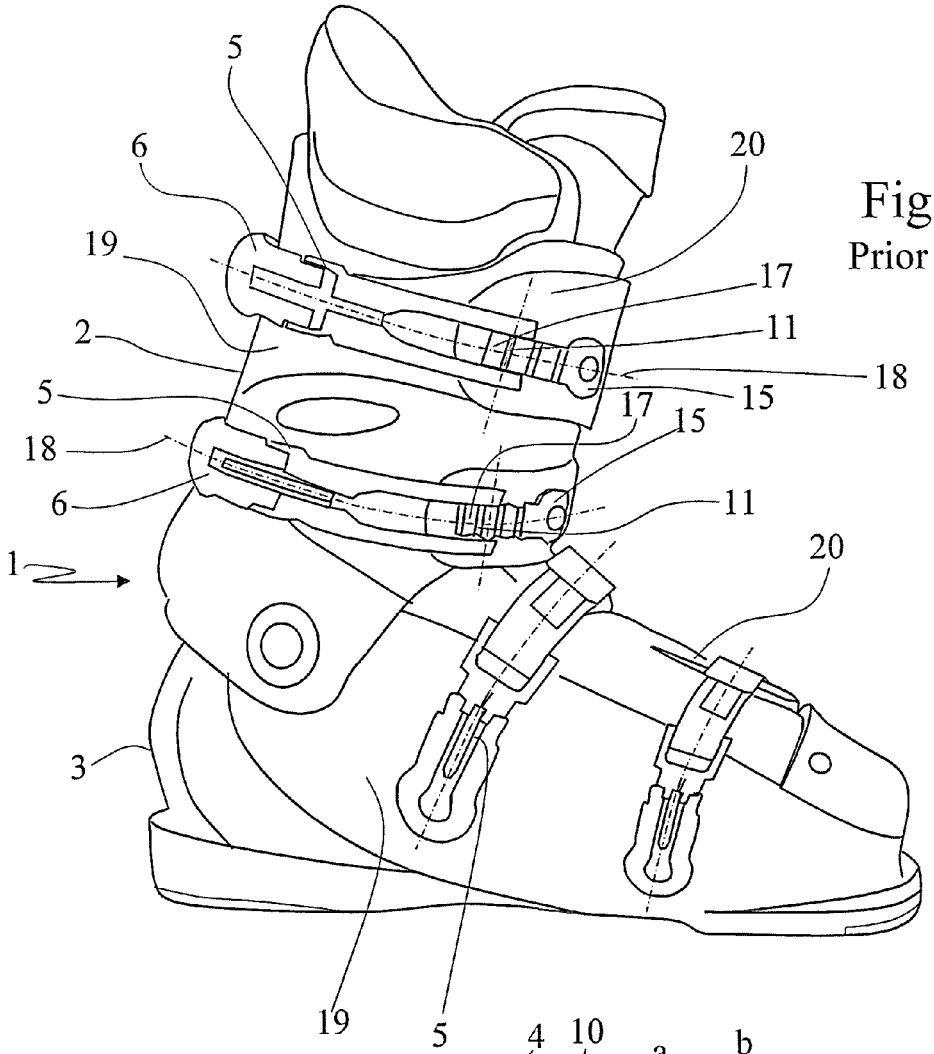
Fig.1 Prior Art
FIG. 1 is a side view of a ski boot of the prior art.
Figure 2:
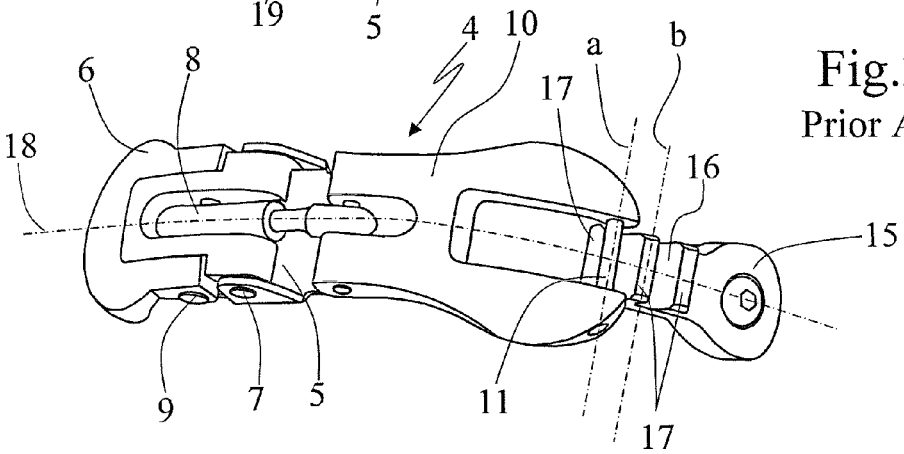
Fig.2 Prior Art
FIG. 2 illustrates a closure and tightening device of the prior art.

In this context, a first solution is for example possible on the basis of a first connecting member with a connecting bar 31 having a geometry similar to that illustrated in FIG. 3, and associated with a conventional second connecting member such as the ratchet illustrated in FIG. 2. Such an embodiment is implemented on a boot by positioning the first connecting member as represented in FIG. 3 and the second connecting member on the tongue 20, these two connecting members being joined to the boot by at least two rivets in order to prevent them from rotating relative to the surface of the boot. In a closure configuration between these connecting members, the connecting bar exerts a force on the corresponding ratchet tooth so that the latter assumes and orientation parallel to the connecting bar, thereby causing a movement which comprises traction and rotation of the tongue 20 on which the ratchet is fixed. The two connecting members thus reach a closed configuration in which they each occupy their respective closure direction, these directions no longer being aligned in this embodiment but having an angle corresponding to the angle of inclination of the connecting bar with respect to the direction of the first connecting member. In this configuration, the two connecting members are however still positioned along the shortest trajectory on the boot allowing this angle to be presented. Since this angle is small, for example 5 degrees, the connecting members remain substantially aligned. In order to accentuate the effect of the connecting members, besides the possibility of modifying the angle of inclination of the first connecting element, it is possible for the positioning of the second connecting member to be offset in height, upward or downward depending on the desired effect. In this solution in which the second connecting member positioned on the tongue 20 is higher than the first, the connecting bar 31 exerts a force inducing stronger forward rotation of the tongue 20, contributing to better holding of the foot at the bottom of the boot.

A second solution might consist in associating a first connecting member having a conventional tie-rod, such as that illustrated in the figure, with a second member of the ratchet type as illustrated in FIG. 3. The technical effect will be equivalent to that obtained previously.

Thus, it is finally found that the intended result may be obtained by providing that at least one of the connecting members has a connecting element with a geometry such that its tangent to a complementary connecting element is not perpendicular to the closure direction of the connecting member, as defined in its configuration for closure and tightening on the surface of the boot. This solution moreover offers an improvement irrespective of the closure direction of the connecting members on the surface of the boot.

Lastly, according to another alternative embodiment (not shown) it is possible to provide the a single type of connecting member which comprises a plurality of potential connecting elements, such as a ratchet with a plurality of teeth, and in which the various connecting elements no longer have the same orientation. Such a solution may make it possible to tailor the effect of the invention according to the tightening carried out.

This solution therefore has the following advantages:

- it is simple and requires only little change in relation to the prior art;
- closure of the boot is still reliably ensured by two elements exerting a force transverse to the notch of the boot, allowing the two opposing tongues to be brought together around the notch of the boot;
- the size of the device is limited, implementation of the invention having no impact on the size;
- the closure and tightening device furthermore exerts another force component in a direction other than that of the connecting members, so that the foot is held better in the boot with tightening equivalent to a solution in the prior art.

The closure and tightening device solution of the invention has been illustrated in the context of a ski boot, although it could be implemented on any other sports boot which is relatively rigid and requires strong tightening.

The invention claimed is:

1. A sports boot closure and tightening device comprising:

a first connecting member comprising:

a first base adapted to be fixed on a first lateral part of the sports boot; and an end part;

a second connecting member comprising:

a second base adapted to be fixed on a second lateral part of the sports boot; and a connecting element comprising a ratchet having teeth or mushroom shaped studs, wherein the end part of the first connecting member and the connecting element of the second connecting member cooperate at a point to close the boot such that, in a closed configuration, the first connecting member and the second connecting member are positioned in alignment along an alignment curve on the first and second lateral parts of the boot, wherein the geometry of the ratchet is such that the tangent of the ratchet teeth or studs at the point of cooperation with the first connecting member is not perpendicular to the alignment curve, wherein the first connecting member comprises a lever movably mounted in rotation on the first base and connected to the end part by a tie-rod, the end part comprising a connecting bar, and wherein the connecting bar is a straight rod arranged in a direction not perpendicular to a closure direction of the first connecting member in the configuration in which it closes and tightens the sports boot, corresponding to the direction of the tie-rod.

2. The sports boot closure and tightening device as claimed in claim 1, wherein the connecting element has a curved shape.

3. A sports boot closure and tightening device comprising:

a first connecting member comprising:

a first base adapted to be fixed on a first lateral part of the sports boot; and an end part;

a second connecting member comprising:

a second base adapted to be fixed on a second lateral part of the sports boot; and a connecting element comprising a ratchet having teeth or mushroom shaped studs, wherein the end part of the first connecting member and the connecting element of the second connecting member cooperate at a point to close the boot such that, in a closed configuration, the first connecting member and the second connecting member are positioned in alignment along an alignment curve on the first and second lateral parts of the boot, wherein the geometry of the ratchet is such that the tangent of the ratchet teeth or studs at the point of cooperation with the first connecting member is not perpendicular to the alignment curve, and wherein the second connecting member comprises a ratchet with straight teeth having an orientation not perpendicular to a closure direction of the ratchet in the configuration in which it closes and tightens the sports boot.

4. A sports boot comprising a first connecting member mounted on a first lateral part of the sport boot and a second connecting member mounted on a second part of the sport boot, positioned beyond a notch, wherein the first connecting member comprises a base adapted to be fixed on the surface of the sports boot, and a lever movably mounted in rotation on the base and connected to an end part by a tie-rod, the end part comprising a straight tie-rod forming a connecting element adapted for cooperation with a second connecting member, wherein the straight tie-rod is arranged in a direction not perpendicular to a closure direction of the connecting member in the configuration in which it closes and tightens the sports boot, corresponding to the direction of the tie-rod and wherein the second connecting member comprises a base adapted to be fixed on the surface of the sports boot and a ratchet with straight teeth adapted for cooperation with the first connecting member, wherein the straight teeth have an orientation not perpendicular to a closure direction, corresponding to the direction of the tie-rod, of the ratchet in the configuration in which it closes and tightens the sports boot.

5. A sports boot comprising:

a first connecting member mounted on a first lateral part of the sport boot; and a second connecting member mounted on a second part of the sport boot, positioned beyond a notch, wherein the first connecting member comprises:

a base adapted to be fixed on the surface of the sports boot;

a lever movably mounted in rotation on the base and connected to an end part by a tie-rod, the end part comprising a connecting bar forming a connecting element adapted for cooperation with the second connecting member, wherein the second connecting member comprises a ratchet with straight teeth adapted for cooperation with the connecting bar, wherein the straight teeth and the connecting bar are parallel and are arranged in a direction not perpendicular to the tie-rod of the first connecting member in the configuration in which it closes and tightens the sports boot.

* * * * *